United States Patent [19]

Schieve

[11] 4,154,356

[45] May 15, 1979

[54] MODULAR CONTAINER

[76] Inventor: Edmund H. Schieve, 3441 W. Redfield Rd., Phoenix, Ariz. 85023

[21] Appl. No.: 907,698

[22] Filed: May 19, 1978

[51] Int. Cl.[2] ..... B65D 25/24; A47F 5/08; A47F 5/00

[52] U.S. Cl. ..... 220/18; 220/22; 248/222.1; 211/88

[58] Field of Search ..... 220/18, 22, 22.1; 248/220.3, 221.1; 211/88, 94, 94.5, 103

[56] References Cited

U.S. PATENT DOCUMENTS

| | | | |
|---|---|---|---|
| 795,484 | 7/1905 | Coble | 220/22 |
| 1,954,646 | 4/1934 | Pratt | 220/22 |
| 3,187,924 | 6/1965 | Marcus | 220/18 |
| 3,222,023 | 12/1965 | Schweitzer | 248/225 |
| 3,891,172 | 6/1975 | Einhorn | 248/222.1 X |
| 4,047,615 | 9/1977 | Browne | 211/88 |

*Primary Examiner*—William Price
*Assistant Examiner*—Steven M. Pollard

[57] ABSTRACT

A modular container adapted to be mounted on apertured board has a semicylindrical channel member which can be secured to such a board by brackets, which brackets removably hold the channel member in position on the board, divide the channel member into compartments, and provide a hinge or pivot for a lid for the container. Standard commercially available apertured board comes in two thicknesses, with the apertures in the boards of the two thicknesses being uniformly spaced, though the diameter of the apertures of thicker board is greater than that of the diameter of the apertures in thinner board. The upper arm of each bracket is provided with a projection with a pair of stops so that the projection can be inserted and removably held in an aperture of such a board of either thickness. The lower arm of each bracket is provided with a hook which catches the rear wall of the thinner board and engages the wall of an aperture of the thicker board to removably secure each bracket to the board. Varying the number of brackets used to mount a given channel member on an apertured board varies the number and size of the compartments into which the channel member of the container can be divided.

14 Claims, 3 Drawing Figures

MODULAR CONTAINER

BACKGROUND OF THE INVENTION

1. Field of the Invention

The present invention relates to modular containers particularly adapted to be mounted or supported on an apertured board.

2. Description of the Prior Art

The use of apertured board such as that sold commercially by the Masonite Corporation under the trademark Peg-Board on which to mount with appropriate hooks tools, packages of nuts, bolts, washers, literally hardware of almost any kind, in the home, in workshops, and in retail establishments, is well known. The prior art also teaches various types of fixtures, brackets and containers adapted to be mounted on apertured board for hlding, storing, or displaying such objects.

It is also well known that apertured board comes in two thicknesses substantially $\frac{1}{8}''$ and $\frac{1}{4}''$ thick. While the apertures, or openings, formed in such boards are substantially uniformly spaced on an orthogonal grid, the centers irrespective of the thickness are spaced 1" apart. The diameter of the holes are substantially 3/16" in the $\frac{1}{8}''$ thick board and 9/32" in the $\frac{1}{4}''$ thick board. Prior art containers adapted to be mounted on Peg-Board have not been modular in the sense that modular implies that one can easily change the dimensions of the storage bins of such containers to accommodate changes in quantities and sizes of objects to be placed in the containers. There thus is a need for an improved container provided with brackets that can be used with standard commercial apertured board of either of the standard thicknesses and which brackets divide the container into a variable number of small compartments of varying sizes to organize or store a variety of small quantities of small parts.

PRIOR ART STATEMENT

The following references are submitted under the provision of 37 CFR 1.97(b):

| | |
|---|---|
| 3,187,924 | Marcus |
| 3,222,023 | Schweitzer |
| 4,047,615 | Browne |

Marcus (U.S. Pat. No. 3,187,924) discloses a container which can be supported on an apertured board. The substantially prismatic container 10 is provided with integrally formed projections 20 which are adapted to be inserted into apertures of board 25.

Schweitzer (U.S. Pat. No. 3,222,023) discloses a mounting device which includes a plastic cap 12 which is provided with three arms 18, 19 and 25. Arms 18 and 19 are provided with hooks 20, 21, while arm 25 is provided with a hook or catch 26. The arms and their respective hooks position the cap 12 on board 10 and removably secure cap 12 to board 10 so that jar 30 can be threaded into cap 12.

Browne (U.S. Pat. No. 4,047,615) discloses a large merchandising unit 10 which is provided with shelving units 12 each of which has a semicylindrical configuration and is divided into a plurality of fixed bins 29. Each shelving unit 12 is supported at opposite ends by support brackets 14 which support, or hold, the unit on pegboard 11 so that unit 12 can rotate or pivot about its longitudinal axis which passes through mounting pins 18.

SUMMARY OF THE INVENTION

The present invention provides a modular container adapted to be mounted on standard commercially available apertured board in either of the two thicknesses in which such board is commercially available. The body of the container is a transparent semicylindrical channel member which is attached to the apertured board and is divided into bins or compartments by brackets. The brackets have an upper and a lower arm which are joined together. The upper arm has a semicircular segment depending from it which has a radius which substantially equals the radius of the inner wall of the channel member. A projection is formed on the upper arm which can be inserted into an aperture in an apertured board. The projection has a pair of stops positioned according to the thickness of standard apertured board so that the projection on the upper arm can be removably secured in an aperture with a stop abutting the inner, or rear, wall of the apertured board. The lower arm is provided with a pointed hook which will engage the rear wall of the thinner apertured board but which engages the walls of the aperture when the bracket is mounted on the thicker apertured board. The lower arm clamps the channel member between the lower arm and the semicircular segment of the upper arm when the lower arm is inserted into an aperture in the apertured board. The upper arm is also provided with a reinforcing member which clamps the channel member between the reinforcing member and the front or outer surface of the apertured board to better secure the channel member to the board. In addition the upper arm is provided with a resilient pivot projection into which the rounded edge of a transparent lid for the container can be inserted so that the lid can be lifted to provide access to the interior of the container or closed to protect the contents.

It is therefore an object of this invention to provide an improved modular container for use with apertured boards of two different thicknesses.

It is another object of this invention to provide an improved modular container for use with apertured boards in which the size of the storage compartments of the container can be easily varied.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENT

Figure 1:
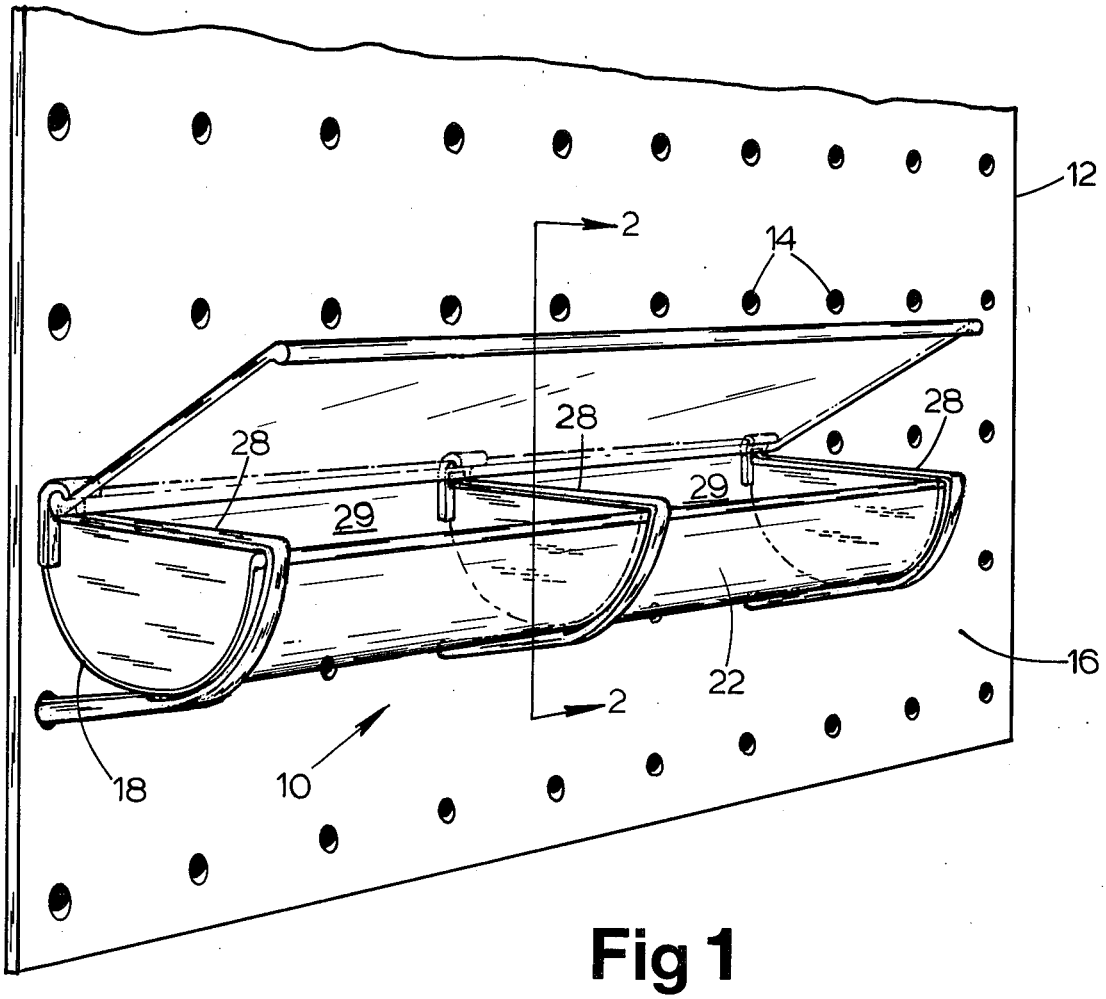
FIG. 1 is a perspective view of the modular container of the present invention.

In FIG. 1 modular container 10 is illustrated as being mounted on apertured board 12. The openings, or apertures, 14 formed in board 12 are laid out on an orthogonal grid so that the distance between centers of openings 14 are 1 inch in commercially available apertured board. It also should be noted that board 12 is normally mounted so that its outer surface 16 is substantially vertical.

Figure 2:
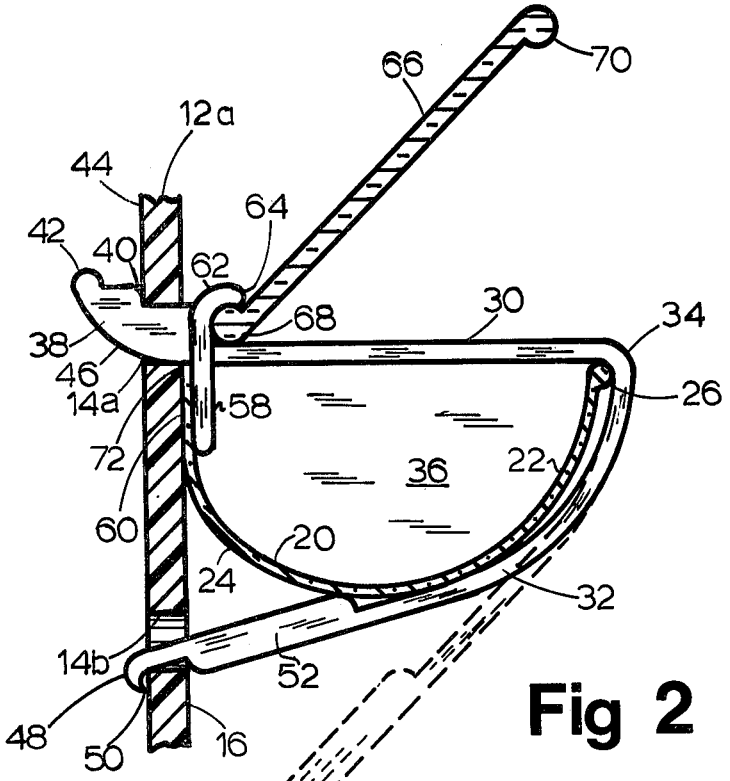
FIG. 2 is a section taken on line 2—2 of FIG. 1.
Figure 3:
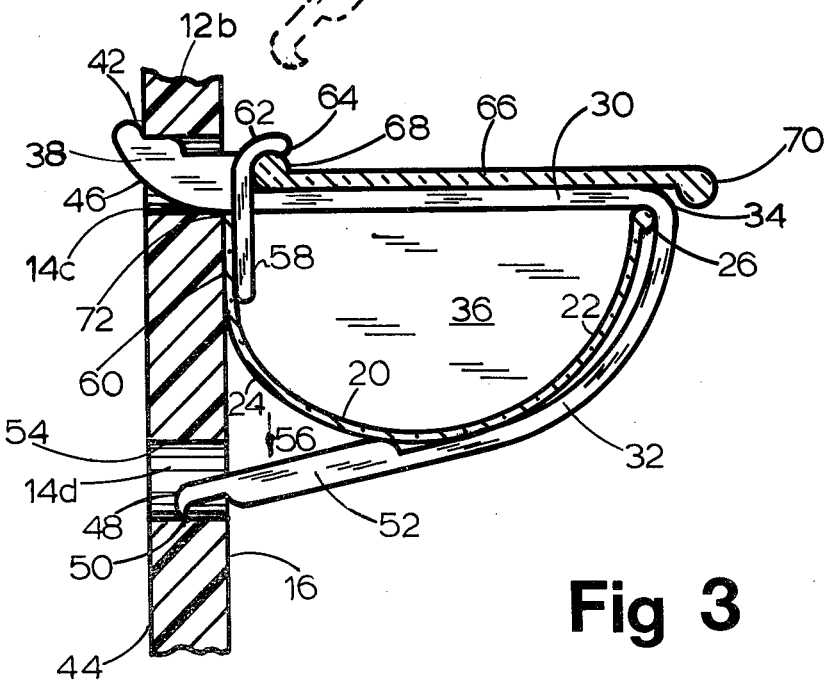
FIG. 3 is similar to FIG. 2 except that it illustrates how a bracket of the modular container is secured to a thick sheet of apertured board.

Container 10 has a semicylindrical body, or channel member, 18 which is preferably made of a transparent plastic such as polystyrene so that objects stored in the container can be seen. In a preferred embodiment the radius of curvature of the inner surface 20 of the curved wall 22 forming body 18 is substantially 0.725 inches. The outer edge 26 of channel member 18 is rounded as is best seen in FIGS. 2 and 3. The length of body 18 is an integral number "n" times the spacing between apertures 14 in board 12, 1 inch in commercially available apertured board plus the width of a bracket 28. In the preferred embodiment "n" is 6, and the length of channel member 18 is substantially 6⅛ inches.

Body 18 is secured to board 12 by a plurality of brackets 28. Brackets 28 also divide the space within body 18 into compartments, or bins, 29. The maximum number of compartments, or bins, 29 that a 6⅛ inch body 18 can be divided into is six which requires seven brackets, and the minimum number of compartments is one, which requires two brackets, one at each end of member 18. Normally a bracket 28 is located at each end of a body 18.

Referring to FIG. 2, bracket 28 is provided with an upper arm 30 and a lower arm 32. The arms 30, 32 are connected together at bend, or joint, 34. Depending from arm 30 is divider 36, a semicircular segment having substantially the same radius of curvature, or radius, as the inner surface 20 of wall 22. Projection 38 is formed at the end of arm 30 remote from bend or joint 34. Projection 38 is provided with a pair of stops 40, 42. Stop 40 is positioned to engage the rear wall 44 of board **12*a*, the thinner version of board 12 which has a thickness of substantially ⅛ inch. The lower surface 46 of projection 38 is curved to facilitate insertion of projection 38 into an opening such as 14*a* and to remove it when desired. Lower arm 32 is provided with a hook 48. Hook 48 is provided with a pointed edge 50 which engages the rear wall 44 of board 12*a* when inserted through opening 14*b* as seen in FIG. 2. A portion 52 of lower arm 32 proximate to hook 50 is made thicker than the rest of arm 32 which stiffens it to increase the downward force exerted by hook 50 when bracket 28 is in the position illustrated in solid lines in FIG. 2. The normal position of lower arm 32 when no force is applied to it is illustrated in dotted lines in FIG. 2**.

In FIG. 3, bracket 28 is illustrated as being inserted into apertures **14*c*, 14*d* of board 12*b* which is the thicker version of the commercially available apertured board and which has a thickness of substantially ¼ of an inch. The diameter of holes 14*c*, 14*d* are substantially 9/32 of an inch and they are placed on 1 inch centers. When bracket 28 is attached to wall 12*b*, for example, body 18 is placed between arms 30, 32. Projection 38 is inserted into opening 14*c* so that stop 42 engages rear wall 44 of board 12*b*. Hook 48 is bent toward upper arm 30 and inserted into opening 14*d*. However, with board 12*b*, the pointed edge 50 of hook 48 does not extend through opening 14*d*, but rather catches, or engages, the side wall 54 forming opening 14*d* as seen in FIG. 3. The force of arm 32 in the direction of arrow 56 is sufficient to cause the sharp, or pointed, edges 50 of hook 48 to bite into, or engage, wall 54 of aperture 14*d* to securely attach bracket 28 and body 18 to board 12*b***.

Upper arm 30 is provided with a reinforcing member 58 which is made sufficiently thick and short to be substantially rigid. Clamping surface 60 of member 58 is spaced from the outer surface 16 of board 12, for example, a distance substantially equal to the thickness of wall 22 of channel member 18. A pivot arm, or projection, 62 is also formed on upper arm 30 substantially directly above reinforcing member 58 as seen in FIG. 3. Pivot 62 is provided with a curved bearing surface 64.

Container 10 is, in the preferred embodiment, provided with a transparent lid, or cover, 66. The edges 68, 70 of lid 66 are rounded and are shaped so that one edge 68, for example, can be forced into pivot 62 so that the surfaces of edge 68 engage the bearing surfaces of pivot 64. As a result lid 66 can be lifted by lifting side, or edge, 70 to provide access to compartments 29.

In the preferred embodiment, brackets 28 are made of nylon which is made opaque and black in color to visually distinguish, or separate, the compartments 29 of container 10. The design of brackets 28 makes it relatively easy to manufacture them using conventional injection molding techniques which reduces the cost of producing them.

To attach, or mount, container 10 on an apertured board 12, the ends of channel member 18 are inserted into a pair of brackets 28 so that the dividers 36 substantially close off or block the open ends of members 18. Inner edge 72 of member 18 substantially contacts the lower surface 46 of projection 38, and the outer edge 26 of channel member 18, which may be rounded to substantially coincide with the curvature of the inner surface of joint 34, is placed adjacent to joint 34. The projection 38 of each bracket is angled into an opening 14 in board 12 while the lower arm 32 of each bracket is bent towards its associated upper arm 30 so that hook 48 of lower arm 32 can be inserted into an opening 14 below the opening into which the projection on its associated upper arm was inserted. The insertion of hook 48 into opening 14 clamps wall 22 of channel member 18 between lower arm 32 and divider 36 as seen in FIG. 3, for example. As upper arm 30 is rotated to make it level and substantially perpendicular to wall 12, that portion of wall 22 of channel member 18 which is between clamping surface 60 of reinforcing member 58 and the outer surface 16 of board 12 is forced to conform substantially to the two surfaces which securely holds member 18 in place on board 12.

After container 10 is mounted by two brackets 28 to board 12, container 10 can be divided into additional modular bins, or compartments, 29 by inserting additional brackets 28 into pairs of openings 14 in board 12 as seen in FIG. 1. Bins, or compartments, 29 are deemed modular since their width is always substantially equal to the product of an integer times the spacing between openings 14 in board 12. To remove a bracket 28, its hook 48 is bent upwardly to disengage the hook from either the back wall 44 of wall **12*a* or from contact with the wall 54 of opening 14*d* as illustrated in FIG. 3. This permits bracket 28 to be rotated to disengage either stop 40 or 42 from contact with rear wall 44 of board 12. The position of lower arm 32 when not inserted into an opening 14 is illustrated in dashed lines in FIG. 2**.

From the foregoing, it is believed abvious that this invention provides a modular container adapted to be mounted on apertured boards having different thicknesses and which container is securely but removably attached to the boards. The brackets used to attach the container to the board also divide the container into a variable number of compartments or bins depending upon the length of the container and the spacing between the openings in the apertured board. As a result the novel modular container has the capability of storing many different small parts in the smallest space.

It should be evident that various modifications can be made to the described embodiments without departing from the scope of the present invention.

What I claim is:

1. A modular container adapted to be mounted on an apertured board having a front wall and a rear wall, said apertured board having two thicknesses, the centers of the apertures in said boards being uniformly spaced, the diameter of the apertures in the thicker board being greater than the diameter of the apertures in the thinner board; comprising:

a semicylindrical channel member of a substantially uniform radius;

a plurality of brackets, each bracket having an upper arm and a lower arm which are joined together;

a divider made integrally with and depending from the upper arm of each bracket, said divider having a radius substantially equal to that of the inner wall of the channel member for dividing the channel member into compartments;

a projection on the upper arm of each bracket adapted to be inserted into an aperture in an apertured board, a pair of stops on said projection, one stop adapted to engage the rear wall of the thinner apertured board and the second stop adapted to engage the rear wall of the thicker apertured board;

a reinforcing member formed on the upper arm of each bracket, said reinforcing member clamping a portion of the channel member against the front wall of an apertured board on which the container is mounted; and a hook formed on the end of the second arm of each bracket, said hook adapted to engage the rear wall of the thinner pegboard and to contact the walls forming the aperture of the thicker board;

said second arm of each bracket adapted to clamp a portion of the channel member between the divider and the second arm when the projection and hook of a bracket are inserted into adjacent apertures of an apertured board.

2. A modular container as defined in claim 1 in which each bracket is provided with pivot means, and a lid for the container having edges, said lid being secured to said pivot means, whereby one edge of said lid can be lifted to provide access to said compartments.

3. A modular container as defined in claim 2 in which the channel member and the lid are transparent.

4. A modular container as defined in claim 3 in which the brackets are opaque.

5. A modular container adapted to be supported on an apertured board having a front wall and a rear wall, said apertured board having two thicknesses, the centers of the apertures in said board being uniformly spaced, the diameter of the apertures in the thicker board being greater than the diameter of the apertures in the thinner board; comprising:

a semicylindrical channel member of a substantially uniform radius, said channel member having walls of substantially uniform thickness, the length of the channel member substantially equaling an integral multiple of the spacing between centers of adjacent apertures of the apertured board;

a plurality of brackets, each bracket having an upper arm and a lower arm which are joined together;

a divider attached to and depending from the upper arm of each bracket, said divider being substantially a segment of a circle having a radius substantially equal to that of the inner wall of the channel member;

a projection on the upper arm of each bracket adapted to be inserted into an aperture in an apertured board, a pair of stops on said projection, one stop adapted to engage the rear wall of the thinner apertured board and the second stop adapted to engage the rear wall of the thicker apertured board;

a reinforcing member formed on the upper arm of each bracket, said reinforcing member being spaced a distance substantially equal to the thickness of the walls of said channel member from the front wall of the apertured board when a stop on its projection is engaged against the rear wall of board;

a hook formed on the end of the second arm of each bracket, said hook adapted to engage the rear wall of the thinner apertured board and to contact the walls forming the apertures of the thicker board, said second arm being spaced from the outer surface of the divider a distance substantially equal to the thickness of the channel member over at least a portion of its length when the projection and hook of a bracket are inserted into adjacent apertures of an apertured board.

6. A modular container as defined in claim 5 in which a pivot arm is formed on the upper arm of each bracket; and a lid for the container is provided having a rounded edge, said lid being pivotally mounted on the container by having its rounded edge engaged by the pivot arms of the brackets.

7. A modular container as defined in claim 6 in which the channel member and lid are transparent.

8. A modular container as defined in claim 6 in which the brackets are opaque.

9. A bracket for a modular container adapted to be supported by a plurality of said brackets on an apertured board, said board having a front wall and a rear wall, said apertured board having two thicknesses, the centers of the apertures in said boards being uniformly spaced, the diameter of the apertures in the thicker board being greater than the diameter of the apertures in the thinner board; said container having a semicylindrical channel member of a substantially uniform radius, and having walls of substantially uniform thickness; said bracket comprising:

an upper arm and a lower arm which are joined together;

a divider attached to and depending from the upper arm, said divider being substantially a segment of a circle having a radius substantially equal to that of the inner wall of a channel member;

a projection on said upper arm adapted to be inserted into an aperture in an apertured board, a pair of stops on said projection, one stop adapted to engage the rear wall of the thinner apertured board and the second stop adapted to engage the rear wall of the thicker apertured board;

a reinforcing member formed on said upper arm, said reinforcing member spaced a distance substantially equal to the thickness of the walls of said channel member from the front wall of the apertured board when said bracket is mounted on an apertured board; and a hook formed on the end of the second arm, said hook adapted to engage the rear wall of the thinner board and to contact the walls of the aperture of the thicker board, said second arm being spaced from the outer surface of the divider a distance substantially equal to the thickness of the channel member over at least a portion of the length of said second arm.

10. A bracket as defined in claim 9 in which a portion of the lower arm proximate the hook is made thicker than the rest of the lower arm.

11. A bracket as defined in claim 10 in which the bracket is provided with a pivot projection to which a lid for the container can be pivotally secured.

12. A bracket as defined in claim 11 in which the bracket is made of opaque plastic material.

13. A bracket as defined in claim 12 in which the plastic material from which the bracket is made is colored substantially black.

14. A bracket as defined in claim 12 in which the material from which the bracket is made is nylon.

* * * * *